US006247552B1

(12) United States Patent
Kovar et al.

(10) Patent No.: US 6,247,552 B1
(45) Date of Patent: Jun. 19, 2001

(54) AIR GAP-INSULATED EXHAUST MANIFOLD

(75) Inventors: Oliver Kovar, Filderstadt; Thomas Nording, Esslingen, both of (DE)

(73) Assignee: J. Eberspächer GmbH & Co. (DE)

( * ) Notice: Subject to any disclaimer, the term of this patent is extended or adjusted under 35 U.S.C. 154(b) by 0 days.

(21) Appl. No.: 09/038,877

(22) Filed: Mar. 11, 1998

Related U.S. Application Data

(63) Continuation-in-part of application No. 08/571,400, filed on Dec. 13, 1995, now abandoned.

(30) Foreign Application Priority Data

Dec. 16, 1994 (DE) ..... 44 44 760

(51) Int. Cl.[7] ..... F01N 7/10; B21D 51/16
(52) U.S. Cl. ..... 181/240; 29/890.08; 60/323
(58) Field of Search ..... 181/238, 240; 60/313, 322, 330, 305, 323; 29/890.08

(56) References Cited

U.S. PATENT DOCUMENTS 2,423,574 * 7/1947 Barrett ..... 181/240
2,611,238 * 9/1952 Fryer, Jr. ..... 60/322
3,505,028 * 4/1970 Douthit ..... 181/240
3,581,494 * 6/1971 Scheitlin ..... 60/323
3,990,856 * 11/1976 Suzuki ..... 60/323
4,034,562 * 7/1977 Taguchi et al. ..... 60/282
4,779,415 * 10/1988 Richardson et al. ..... 60/313
5,170,557 * 12/1992 Rigsby ..... 29/890.08
5,331,810 * 7/1994 Ingermann et al. ..... 60/322
5,349,817 * 9/1994 Bekkering ..... 60/322
5,471,857 * 12/1995 Dickerson ..... 72/57
5,572,867 * 11/1996 Bekkering et al. ..... 60/305
5,697,215 * 12/1997 Canevet et al. ..... 60/299
5,768,890 * 6/1998 Bekkering et al. ..... 60/305
5,809,778 * 9/1998 Nording ..... 60/323

FOREIGN PATENT DOCUMENTS 42 00 611 A1 7/1993 (DE) .

* cited by examiner

*Primary Examiner*—David M. Gray
(74) *Attorney, Agent, or Firm*—McGlew and Tuttle, P.C.

(57) ABSTRACT

An air gap-insulated exhaust manifold with a double-walled design provided only in the area of the collection pipe, while only a single-walled design is provided in the area of the individual pipes. The outer pipe includes two half shells, while the gas-carrying inner pipe is manufactured especially from one or more partial sections according to the inner high-pressure process.

20 Claims, 2 Drawing Sheets

AIR GAP-INSULATED EXHAUST MANIFOLD

This is a continuation-in-part application of application Ser. No. 08/571,400 filed Dec. 13, 1995, now abandoned.

FIELD OF THE INVENTION

The present invention pertains to an air gap-insulated exhaust manifold with an end-side outlet opening, a collection pipe, and lateral inlet openings, wherein the outer pipe and the inner pipe are shaped parts made of sheet metal.

BACKGROUND OF THE INVENTION

Air gap-insulated, double-walled exhaust manifolds have been increasingly used especially in exhaust systems of motor vehicles which together with other air gap-insulated, double-walled exhaust pipes provide for the optimal operation of an emission control device (catalytic converter) arranged downstream of them. They bring about a reduction in the amount of heat released from the exhaust gas to the environment, so that the exhaust gas flows to the emission control device at a higher temperature than in single-walled exhaust manifolds and exhaust pipes. This is significant especially during the warm-up phase of the internal combustion engine, because the catalyst will thus rapidly reach its working temperature.

Prior-art double-walled exhaust manifolds have an outer pipe and a one-part or multipart inner pipe, which are shaped parts made of sheet metal in a half-shell design. After the pressing of the sheet metal, the blanks are assembled, and the outer half shells of the outer pipe are welded together. Such a manufacturing process is relatively expensive and requires many individual parts, along with an increased material consumption.

SUMMARY AND OBJECTS OF THE INVENTION

It is an object of the present invention to provide an air gap-insulated exhaust manifold of the type described in the introduction, which has a very simple and especially material-saving design and has an unlimited, full ability to function.

According to the invention, an air gap-insulated exhaust manifold is provided including an end-side outlet opening, a collection pipe and lateral inlet openings. The exhaust manifold is formed by an outer pipe and an inner pipe which are shaped parts made of sheet metal. The inner pipe is gas-carrying and is provided only in the area of the collection pipe. Gas-carrying outer pipe sections are provided in the area of the inlet openings with the outer pipe defining an air gap with the gas carrying inner pipe in the area of the collection pipe.

The inner pipe is preferably formed of partial sections, the partial sections preferably overlapping at a point of connection.

Preferably the inner pipe is designed as a thin-walled pipe. The inner pipe is preferably manufactured according to a hydrostatic pressing process. The inner pipe may include the one-piece of pipe section with at least a pipe branch which points in the direction of the inlet opening. Each of these pipe branches may be mounted in a snug fit in the outer pipe. The inner pipe is preferably mounted in a sliding seat in the outer pipe.

A two-dimensional local spacing structure is arranged between the outer pipe and the inner pipe. The spacing structure may be in the form of depressions of the outer pipe or the inner pipe. The spacing structure may also be in the form of shaped wire mesh parts.

The one part or multipart inner pipe is fixed or even more preferably welded at least at one point in relation to the outer pipe. Gas carrying outer pipe sections may be provided as the separate sections.

The essence of the present invention is to provide the gas-carrying inner pipe only in the area of the collection pipe, while gas-carrying outer pipe sections are provided in the area of the inlet openings.

Thus, the present invention provides for a double-walled exhaust manifold in partial areas only, namely, in the areas which are subject to a high thermal load during the operation of the internal combustion engine. The zones of an exhaust manifold which are subject to high thermal load are especially the outside, which is located opposite the lateral inlet openings of the exhaust manifold, and generally the collection pipe of the exhaust manifold itself, because the throughput is substantially higher there than in the individual pipes, which are fastened to the cylinder head flange of an internal combustion engine. The individual pipes arranged downstream of the cylinder head are consequently subject to a lower thermal load.

As can be seen, a considerable amount of material can be saved by designing a double-walled exhaust manifold only partially. In addition, the zones of the inner pipe which are subject to high thermal load may be designed as very thin-walled zones, which are supported on the outer pipe. A small "thermal mass" is formed as a result, which is advantageous during operation especially during the warm-up phase of an engine. The exhaust gases are thus sent to a catalytic converter rapidly and with a very high temperature in the case of a cold start. The use of a reduced amount of material not only leads to advantages in terms of costs, but it also ensures a low overall weight of an exhaust manifold.

It is particularly advantageous for the inner pipe to be manufactured according to a hydrostatic pressing process. The one-part or multipart inner pipe is manufactured in such a process from circumferentially closed pipe sections, which are preferably straight. A pipe section is placed into a two-part calibrating mold, whose interior space is the desired contour of the completed, manufactured inner pipe. The two pipe ends are closed by sealing mandrels in a pressure-sealed manner, and at least one sealing mandrel communicates with a pressure source. With a pressurized medium, especially an aqueous emulsion, the pressure source exerts a very high pressure in the interior of the inner pipe, which undergoes deformation corresponding to the calibrating mold.

The application of an above-mentioned inner high-pressure process for deforming the inner pipe is particularly suitable because the inner pipes according to the present invention have relatively short branches, which point in the direction of the inlet openings of the exhaust manifold. Only a small amount of pipe material must be deformed, so that the wall thickness of the inner pipe can be selected to be very thin even for the blank, because the inner high-pressure deformation technique has its limits in the dome (curvature) height and in the direction of the domes, which can be pulled out of the pipe as branches. In exhaust manifolds, these branches usually have acute angles for reasons of proper flow guidance, which is an unfavorable condition concerning the attainable dome height. If a great dome height is required, it is also necessary, in principle, to have a starting material of great wall thickness, which is precisely untrue in the case of the present invention. An acute-angle pipe routing can be achieved substantially better due to the shorter dome height in the present invention. The guidance of the exhaust gas flow is more favorable as a result, which leads to a further optimization of the output of the engine.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
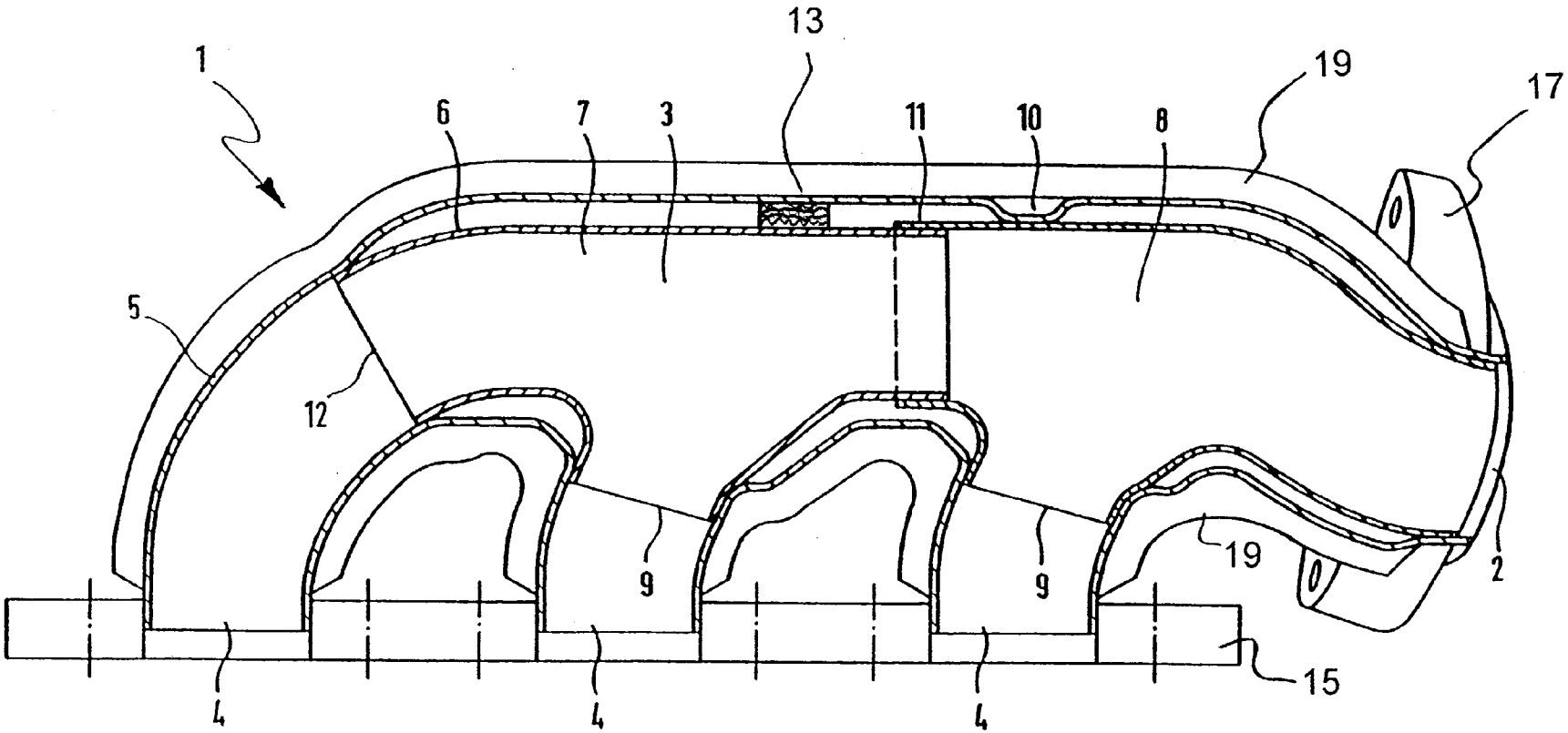
FIG. 1 is a schematic cutaway top view of an air gap-insulated exhaust manifold.

According to FIG. 1, an air gap-insulated exhaust manifold 1 is provided, which is flanged laterally to a cylinder head (not shown) of an internal combustion engine. It has three inlet tubes with openings 4 connected to port connection means 15. Exhaust gas of an internal combustion engine flows through the inlet tubes to reach a central outlet opening 2 via a collection pipe 3. The outlet opening 2 is connected via an exhaust pipe connection means 17 to a connection or exhaust pipe which connects to a catalytic converter and then to a muffler system of a motor vehicle, which is arranged downstream of it.

The exhaust manifold 1 includes especially an outer pipe 5 consisting of two half shells. FIG. 1 schematically shows only the lower half shell.

The outer pipe 5 is manufactured according to the half-shell technique, i.e., from two separate half shells, which are shaped sheet metal parts and which are connected to one another via a lock seam 19 after the final assembly of the exhaust elbow 1.

The exhaust manifold 1 also has an inner pipe 6 with first end 12 and second end adjacent the outlet opening 2. The inner pipe 6 includes two pipe sections 7 and 8, which have mostly the same configuration, especially with respect to the two pipe branches 9 of each pipe section 7 and 8, which point in the direction of two cylinders of the internal combustion engine.

Each pipe section 7, 8 is manufactured from a straight, one-piece pipe as a blank, according to an inner high-pressure process. A favorable dome height was determined in the experiment. The shaping of the outer insulating half shells of the outer pipe 5 is then performed corresponding to this dome height of the pipe branches 9.

The inner pipe 6 is manufactured according to a hydrostatic shaping process, which is a single part or may be composed of a plurality of individual parts. Two parts 7 and 8 are provided as the inner pipe in the exemplary embodiments according to FIGS. 1 and 2. The two parts 7 and 8 are prefabricated in this case separately according to the hydrostatic shaping process, each from a straight pipe section used as a blank, which is closed on its circumference and has openings in the front and back. To prepare the lateral branching opening 9 according to FIG. 1, the sheet metal pipe is expanded laterally from the inside in the cold state by means of a mandrel. The mandrel is pushed in through the front or rear opening of the pipe. The pipe is cold-deformed, but only pre-deformed, i.e., it is not yet brought to its final shape is according to the drawing. To obtain the final shape of the inner pipe according to the drawing, the pipe, pre-deformed by means of a mandrel and pre-bent by means of a mandrel, is placed into a negative mold of the inner pipe, and a hydrostatic inner pressure is generated inside the pipe via a hydraulic medium, and this hydrostatic inner pressure expands the pipe due to the hydraulic force and presses it exactly into the above-mentioned negative mold, i.e., it cold-deforms it into the final shape according to the drawing ("hydrostatic shaping process"). The circumferential edge of the openings will, of course, be cut off.

The pipe branches 9 are relatively short. The arrangement selected is such that the gas-carrying inner pipe is provided only in the area of the collection pipe 3, and gas-carrying outer pipe sections or inlet tubes are provided in the area of the three inlet openings 4 and of the outlet opening 2. The double-walled design of the exhaust manifold is thus provided only in the central area of the collection pipe 3, but the single-walled guidance is provided for the gas in the area of the individual pipes. This leads to an inexpensive design of an air gap-insulated exhaust manifold. The zones of the exhaust manifold which are subject to high thermal load are also designed as double-walled zones. The short pipe branches 9 of each inner pipe section 7, 8 have a small dome height. Thus, it is also possible to press only a small amount of material of the inner pipe 6 according to the inner high-pressure process, so that even the blank of a straight pipe can be designed as a very thin-walled blank.

For mounting, the premanufactured pipe sections 7, 8 of the inner pipe 6 are first inserted into each other at their point of connection 11 in a positive-locking manner, and they are placed together into the lower half shell of the outer pipe 5 in a snug fit. The pipe branches 9 and the pipe opening 12 of the pipe section 7, which is the left-hand pipe opening in FIG. 1, as well as the pipe end at the outlet opening 2 are guided in the outer pipe 5 in a positive-locking manner.

The separately prefabricated inner pipe is placed fittingly into one of the prefabricated half shells (lower half shell) of the outer pipe to assemble the exhaust elbow. The other (upper) half shell of the outer pipe is then placed on it fittingly. With the half shells of the outer pipe closed, the inner pipe is fixed automatically, i.e., by itself, at the openings of the inner pipe (at the reference numbers 12, 9 and 2 according to FIG. 1), and the openings are located in a sliding fit in relation to the outer pipe, but they may partly also be fixed axial fits (e.g., in the case of the reference numbers 9 and 2 according to FIG. 1).

If two parts 7 and 8 are provided as the inner pipe (according to FIGS. 1 and 2) in an advantageous variant of the present invention, the two inner pipes 7 and 8 are simply put together coaxially in the outer half shells before the assembly, forming a sliding fit 11, and the two parts 7 and 8 put together are placed into the lower half shell only thereafter, before the other half shell is placed on it and the lock seam 13 is prepared.

Two-dimensional, local spacing means in the form of impressions, which are either fastened to the outer pipe 5 or the inner pipe 6 or are integral parts of these parts, are located between the outer pipe 5 and the inner pipe 6 in the area of the point of connection 11. The spacing means may also be designed as shaped wire mesh parts 13.

The pipe sections 7, 8 of the inner pipe 6 may also be fixed by welding in the dome area of the pipe branches 9.

The arrangement is selected to be such that the inner pipe 6 is guided generally displaceably in relation to the outer pipe 5 in order to compensate different thermal expansions between the inner pipe and the outer pipe.

Figure 2:
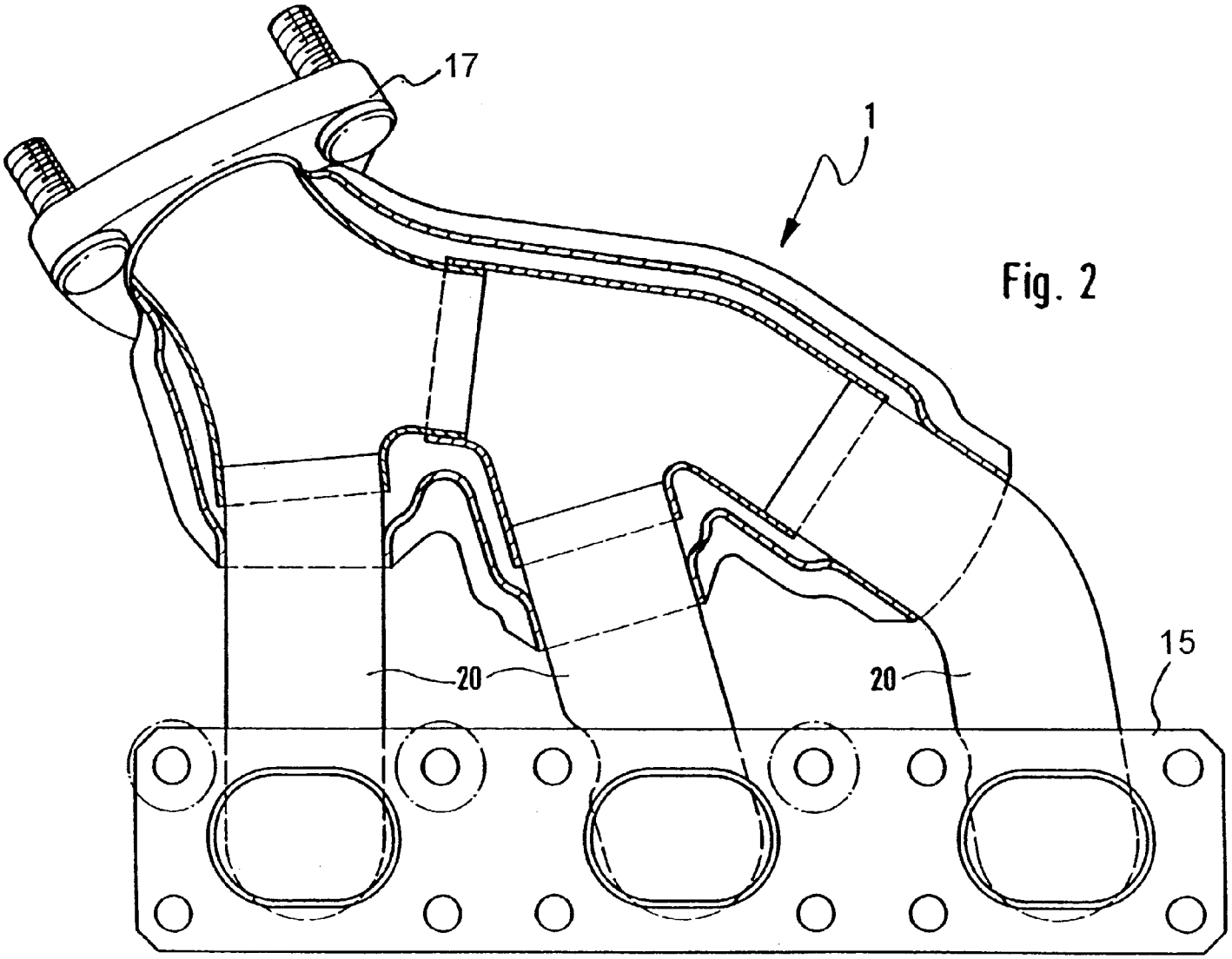
FIG. 2 is a view similar to that shown in FIG. 1 of another design variant of an air gap-insulated exhaust manifold.

The design variant of an air gap-insulated exhaust manifold 1 illustrated in FIG. 2 provides for separate pipe sections 20 as gas-carrying outer pipe sections, which are longer than the pipe sections of the first design variant according to FIG. 1 and are rigidly fastened to the basic body of the outer pipe. This leads to the following advantages: On the one hand, it is not absolutely necessary to actually lead the gas-carrying outer pipe sections to the engine connection flange in the area of the inlet openings. On the other hand, the use of such separate pipe sections 20 makes it possible to adapt the length of these pipe sections to the actual requirements of the construction, i.e., different pipe sections 20 can be modularly combined with the same (compact) outer pipe/inner pipe arrangement according to the present invention.

While specific embodiments of the invention have been shown and described in detail to illustrate the application of the principles of the invention, it will be understood that the invention may be embodied otherwise without departing from such principles.

What is claimed is:

1. A process for forming an air-gap insulated exhaust manifold, the process comprising the steps of:

providing an inner pipe with first and second inner pipe ends;

hydrostatic pressing said inner pipe to expand and a portion of said inner pipe and form a branch in said inner pipe;

stamping first and second sheets into first and second shells into a shape, said shape being formable into a double wall with, and supporting, said inner pipe when said first and second shells are combined around said inner pipe;

placing said inner pipe in said first shell;

connecting said second shell to said first shell to form said double wall with said inner pipe and to support said inner pipe in said first and second shells, said shells and said inner pipe ending said double wall at said second end of said inner pipe;

connecting inlet tubes to said first end and said branch of said inner pipe, said double wall ending at said inlet tubes;

connecting port connection means to said inlet tubes for connecting said inlet tubes to exhaust ports of an engine;

connecting exhaust pipe connection means to an end of said double wall adjacent said second end of said inner pipe for connection to an exhaust pipe of the engine.

2. A process in accordance with claim 1, wherein:

said inner pipe forms a closed path between said first and second ends and said branch.

3. A process in accordance with claim 1, wherein:

said hydrostatic pressing includes placing the inner pipe in a mold, and pressurizing an inside of said inner pipe in said mold to form said branch in a closed circumference of said pipe section.

4. A process in accordance with claim 1, further comprising:

forming portions of said inlet tubes with said stamping of said first and second sheets, said portions being homogeneous with said first and second shells;

forming said inlet tubes during said connecting of said first and second shells.

5. A process in accordance with claim 1, wherein:

said shape and said connecting of said first and second shells forms a continuously closed said double wall from said first end and said branch of said inner pipe to said second end of said inner pipe;

said ending of said double wall at said first end and branch is spaced from said port connection means;

said first and second shells completely surround a circumference of said inner pipe;

space between said double wall is filled with gas.

6. A process in accordance with claim 1, wherein:

said forming of said inner pipe includes providing a plurality of pipe sections with pipe section ends, hydrostatic pressing a plurality of pipe sections to form a branch in each said pipe section, and connecting said pipe section ends of said plurality of pipe sections together to form said inner pipe.

7. A process in accordance with claim 1, wherein:

said inner pipe is straight and is expanded laterally from an inside in a cold state by mandrel means prior to said hydrostatic pressing;

said inner pipe is also bent by said mandrel means prior to said hydrostatic pressing.

8. A process in accordance with claim 1, wherein:

said hydrostatic pressing forms a dome in a side of said inner pipe and a portion of said dome is cut off to form said branch.

9. A process in accordance with claim 1, further comprising:

connecting said exhaust pipe connection means directly to said double wall adjacent said second end of said inner pipe;

welding said inner pipe to said first and second shells.

10. An air-gap insulated exhaust manifold comprising:

an inner pipe with a branch formed by hydrostatic pressing, said inner pipe having first and second ends, said inner pipe forming a closed path between said first and second ends and said branch;

first and second shells formed from stamped sheets and combined around said inner pipe to form a double wall with, and supporting, said inner pipe, said first and second shells form a continuously closed said double wall from said first end and said branch of said inner pipe to said second end of said inner pipe;

inlet tubes connected to said first end and said branch of said inner pipe, said double wall ending at said inlet tubes;

port connection means connected to said inlet tubes for connecting said inlet tubes to exhaust ports of an engine;

exhaust pipe connection means connected to said second end of said inner pipe for connection to an exhaust pipe of the engine.

11. An air-gap insulated exhaust manifold in accordance with claim 10, wherein:

portions of said inlet tubes are formed with said stamping of said first and second sheets, and said portions are homogeneous with said first and second shells.

12. An air-gap insulated exhaust manifold in accordance with claim 10, wherein:

said ending of said double wall at said first end and branch is spaced from said port connection means;

said first and second shells completely surround a circumference of said inner pipe.

13. An air-gap insulated exhaust manifold in accordance with claim 10, wherein:

said inner pipe is formed from a plurality of pipe sections, each said pipe section being hydrostaticly pressed to form said branch, an end of one pipe section being connected to an end of another pipe section to form said inner pipe.

14. An air-gap insulated exhaust manifold in accordance with claim 10, wherein:

space between said double wall is filled with gas.

15. An air-gap exhaust manifold according to claim 10, wherein:

said inner pipe is mounted in a sliding seat in said first and second shells.

16. An air-gap exhaust manifold according to claim 10, further comprising:

a two-dimensional, local spacing means arranged between said first and second shells and said inner pipe, for maintaining a space between a wall formed by said first and second shells and a wall formed by said inner pipe.

17. An air-gap exhaust manifold according to claim 16, wherein:

said spacing means comprises one of depressions formed in one of said first and second shells and said inner pipe, and shaped wire mesh parts.

18. An air-gap insulated exhaust manifold formed by the process of:

providing an inner pipe with first and second inner pipe ends;

hydrostatic pressing said inner pipe to expand a portion of said inner pipe and form a branch in said inner pipe;

stamping first and second sheets into first and second shells into a shape, said shape being formable into a double wall with, and supporting, said inner pipe when said first and second shells are combined around said inner pipe;

placing said inner pipe in said first shell;

connecting said second shell to said first shell to form said double wall with said inner pipe and to support said inner pipe in said first and second shells, said shells and said inner pipe ending said double wall at said second end of said inner pipe;

connecting inlet tubes to said first end and said branch of said inner pipe, said double wall ending at said inlet tubes;

connecting port connection means to said inlet tubes for connecting said inlet tubes to exhaust ports of an engine;

connecting exhaust pipe connection means to an end of said double wall adjacent said second end of said inner pipe for connection to an exhaust pipe of the engine.

19. An air-gap insulated exhaust manifold in accordance with claim 18, wherein:

said inner pipe is straight and is expanded laterally from an inside in a cold state by mandrel means prior to said hydrostatic pressing;

said inner pipe is also bent by said mandrel means prior to said hydrostatic pressing.

20. An air-gap insulated exhaust manifold in accordance with claim 18, wherein:

said hydrostatic pressing forms a dome in a side of said inner pipe and a portion of said dome is cut off to form said branch.

* * * * *